US006951246B2

(12) United States Patent
Tessier et al.

(10) Patent No.: US 6,951,246 B2
(45) Date of Patent: Oct. 4, 2005

(54) SELF-ANCHORING CEMENTING WIPER PLUG

(75) Inventors: Lynn P. Tessier, Cochrane (CA); John P. Doyle, Calgary (CA); James L. Weber, Calgary (CA)

(73) Assignee: MSI Machineering Solutions Inc., Providenciales (TC)

( * ) Notice: Subject to any disclaimer, the term of this patent is extended or adjusted under 35 U.S.C. 154(b) by 134 days.

(21) Appl. No.: 10/640,056

(22) Filed: Aug. 14, 2003

(65) Prior Publication Data

US 2004/0065435 A1 Apr. 8, 2004

(30) Foreign Application Priority Data

Oct. 3, 2002 (CA) ..... 2406748

(51) Int. Cl.[7] ..... E21B 33/16
(52) U.S. Cl. ..... 166/153; 166/156
(58) Field of Search ..... 166/134, 135, 166/202, 192, 153, 154, 155, 156

(56) References Cited

U.S. PATENT DOCUMENTS 4,756,365 A * 7/1988 Schneider ..... 166/153
5,095,988 A * 3/1992 Bode ..... 166/291
5,323,858 A * 6/1994 Jones et al. ..... 166/291
5,522,458 A 6/1996 Watson et al.
6,237,686 B1 * 5/2001 Ryll et al. ..... 166/153
6,739,398 B1 * 5/2004 Yokley et al. ..... 166/382
2004/0104025 A1 * 6/2004 Mikolajczyk ..... 166/153

OTHER PUBLICATIONS http://www.workover.co.uk/c...20online%20training%20balance%20plug.htm, Aug. 1, 2002, 2 pages.

http://www.workover.co.uk/casingstrings/casing%20online%20training%20production.htm, Jun. 19, 2002, 2 pages.

Halliburton Energy Services, Inc. product information, *Plug Setting Aids*, Nov. 1997, 2 pages.

* cited by examiner

*Primary Examiner*—David Bagnell
*Assistant Examiner*—Daniel P Stephenson
(74) *Attorney, Agent, or Firm*—Sean W. Goodwin; Linda M. Thompson

(57) ABSTRACT

A self-retaining cementing wiper plug has two or more steel or carbide tipped holddown fingers or slips extending radially outward from the plug for engaging the inner surface of the casing and preventing the plug from moving uphole over time and potentially interfering with other downhole apparatus such as a pump.

19 Claims, 6 Drawing Sheets

SELF-ANCHORING CEMENTING WIPER PLUG

FIELD OF THE INVENTION

The invention relates to cementing wiper plugs used in cementing casing downhole and particularly to top cementing plugs used for cementing production casing.

BACKGROUND OF THE INVENTION

It is conventional practice, in the drilling and completion of wells, to case an open hole by cementing tubular casing in place in a wellbore. Thus, the open hole is prevented from caving in, fragile formations are protected, inter-zonal communication is restricted and contamination of groundwater is prevented. In the course of cementing the casing, components are placed in the well which can later migrate and possibly interfere with well operations. To understand the phenomena, cementing operations are reviewed herein.

A string of casing is made up and lowered into the open wellbore. Prior to the placement of cement, the casing and hole are filled with drilling mud, which must be displaced for placing cement.

In the case of surface and intermediate casing, in order to reduce contamination of the interface between the displaced mud and the cement, a bottom cementing plug is placed in the casing and pumped ahead of the cement slurry. The bottom plug is typically constructed with a one piece hollow metallic or a one piece non-metallic core having an elastomer covering molded to the core. The elastomer cover typically incorporates a plurality of wipers. The function of the wipers is to wipe the internal surface of the casing, maintain the separation of fluids during the displacement of the cement slurry down the casing and provide a means of sealing upon displacement of the plug. The bottom plug incorporates a rupture diaphragm or valve that will rupture or open upon the bottom plug reaching or resting on a float shoe, float collar or landing collar located near or at the bottom of the casing. An increase in fluid pressure above the supported bottom plug results in the diaphragm rupturing, allowing the cement slurry to pass though the bottom plug and continue out the bottom of the casing, beginning to fill the annular space between the casing and the well bore.

When the necessary volume of cement has been placed into the casing, a top plug is positioned on top of the cement for separating the cement from a driving slug of mud. The top plug is typically constructed having a solid elastomer, one piece metallic or one piece non-metallic core having an elastomer covering molded to the core, the elastomer cover incorporating a plurality of wipers. Optionally, the top plug may also have a rupture element, as described in U.S. Pat. No. 5,191,932 and incorporated herein by reference in its entirety, so that if the top and bottom plugs are inadvertently reversed, in operation, cementing can continue without removal of the plug or removal of cement placed into the wellbore before the error was discovered. Pressures required to rupture the diaphragm are such that the diaphragm will not rupture during normal operations. The function of the wipers is to wipe the internal surface of the casing, maintain the separation of fluid during the displacement of cement slurry down the casing using drilling fluid and to provide a method of providing a sealing mechanism across the casing upon landing the top plug on top of the bottom plug. When displacement of the cement slurry is complete the top plug will land on top of the bottom plug and is expected to remain in this position once the cement hardens.

After the cement slurry has become hard, the top and bottom plugs are drilled out. Additional drilling can then proceed through the cemented casing. Additional lengths of casing are hung in the cemented casing and the cementing operation is repeated.

The last segment of casing to be positioned in the wellbore is the production casing. It is typically smaller in diameter than either the surface or intermediate casing and extends to the bottom of the wellbore. As no further drilling will occur after the production tubing has been run in and cemented, the plugs are not drilled out, but instead are left cemented into the bottom of the hole. As with the previous cementing operations, a bottom plug is run ahead of the cement and a top plug is run behind. Once the top plug rests on the bottom plug, pressure sufficient to keep the plugs at the bottom of the hole, but not to rupture the diaphragm in the top plug, if present, is maintained on the plugs for approximately 8 hours to permit the cement to properly set.

Once the wellbore has been cased, the casing is perforated above the plugs at a zone of interest and the wellbore is ready for production. A tubing string and pump are lowered into the casing and fluids are produced up the tubing string to surface.

Applicant is aware that in many cases, often a year or more after the cementing of the casing, the top cementing plug can migrate up the production casing to the pump intake and cause fouling of the pump. Typically, most wellbores have a minimum overhole, that is to say that the bottom of the casing is not far below the zone to be perforated. The Applicants believe that during perforation of the casing, the cement surrounding the plugs and outside the casing may be fractured. If sufficient fracturing occurs, the plugs are no longer held securely inside the casing and can migrate upwards. It is also possible that gas from the formation can travel downward through the fractured cement outside the casing and rise at the bottom of the casing to apply pressure on the plugs. If the one-way valves in the float equipment are also damaged as a result of pressure pulses during perforation, the plugs may be forced upwards due to the increased pressure from below.

Traditionally, whenever the pump intakes are fouled, production is lost and the tubing is tripped out of the well to repair the pump, at great expense. A solution that has been employed to prevent plugs from migrating upwards into the pump intake is to run a bridge plug into the casing and set it down on the top cementing plug to anchor the plug in position. Whether repairing the pump or setting a bridge plug, significant expense is involved in both equipment and rig time.

Regardless of the reason or hypothesis for plug migration, clearly there is a need for means to prevent the cementing plug from migrating up the casing. Ideally, such means would be incorporated directly into the plug, thus realizing significant cost and time savings.

SUMMARY OF THE INVENTION

A self-retaining cementing wiper plug comprises two or more holddown fingers biased radially therefrom and extending outward for engaging an inner surface of the casing once the plug is positioned at the bottom of the casing. Substantially, regardless of the formation, the novel plug is prevented from migration. The holddown fingers are angled uphole, as are the wipers, to enable insertion into the casing bore and are flexible relative to the plug only in so much as the elastomeric body in which they are embedded flexes or the attachment to the core of the plug permits limited flex, to permit insertion. The fingers themselves are substantially inflexible so as to resist flexing once engaged with the casing to prevent movement of the plug uphole.

In a broad aspect of the invention, an improvement to conventional cementing wiper plugs is provided having a plurality of radially extending, elastomeric wipers extending therefrom for insertion into a production casing for wiping an inner casing surface is provided, the improvement comprising one or more upwardly angled, substantially inflexible projections biased radially outward from the cementing plug wherein the projections are moveable inwardly sufficiently so as to permit insertion of the plug downwardly into the casing and are sufficiently inflexible to restrict uphole movement of the plug in the casing.

In a preferred embodiment of the invention, the substantially inflexible holddown fingers are steel or carbide-tipped fingers embedded at a first end in the elastomeric covering of the plug and extending outward to engage the inner surface of the casing at a second end. The fingers extend at least the extent of the flexed wipers and can be positioned between the wipers or embedded within the wipers. Even one hold down finger, but preferably two or more holddown fingers positioned 180 degrees from one another, are sufficient to secure the plug in the casing.

The holddown fingers can be individually embedded into the elastomeric covering or can be attached, such as adjacent their base, to a ring which is positioned about the core and embedded in the elastomeric covering. Further, the first end of the fingers or an inner edge of the ring can be formed into an anchor for more securely embedding the fingers in the elastomer.

Optionally the fingers can be attached to and extend outward from the core of the plug or be slips biased outwardly by the elastomer.

DETAILED DESCRIPTION OF THE PREFERRED EMBODIMENT

Figure 1:
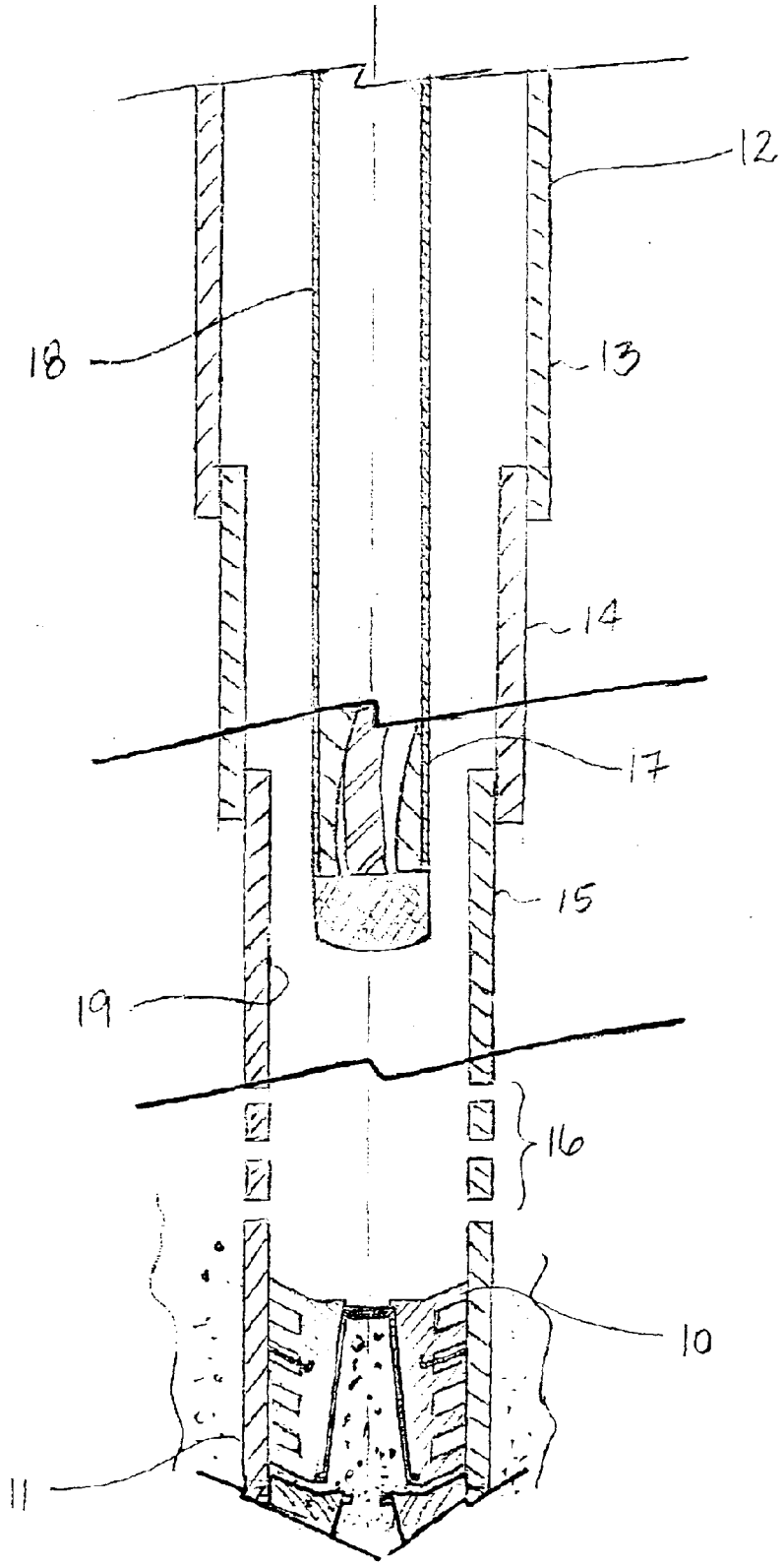
FIG. 1 is a schematic cross-sectional view of a wellbore casing string having a top cementing plug of the present invention positioned on or adjacent a bottom end of the production casing.

With reference to FIG. 1, a cementing plug 10 of the present invention is shown positioned adjacent a bottom 11 of a casing string 12 comprising, in order beginning from surface (not shown): surface casing 13, intermediate casing 14 and production casing 15. The cementing plug 10 is located below a plurality of perforations 16 in the production casing 15 and below a pump 17 lowered into the casing 12 at the end of a production string 18.

Figure 2:
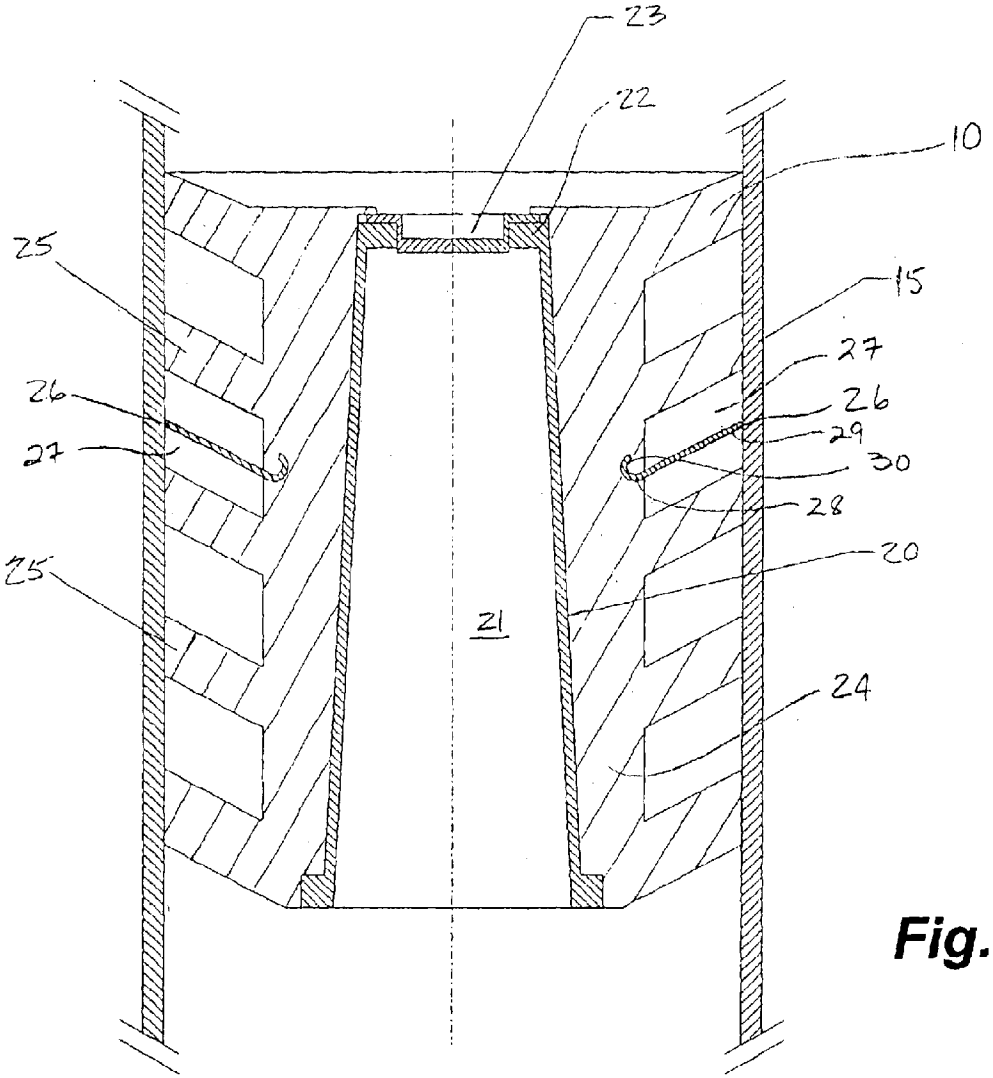
FIG. 2 is a cross-sectional view of a first embodiment of the invention according to FIG. 1 and showing holddown fingers embedded in the cementing plug and protruding between the wipers for engaging the production casing.

As shown in FIG. 2, and in a preferred embodiment of the invention, the cementing plug 10 comprises a core 20. The core 20 is covered with an elastomeric covering 24 having a plurality of wipers 25 formed thereon. Preferably, the core 20 defines a bore 21 therethrough. A top end 22 of the core 20 is fitted with a rupture element 23 to permit the passage of cement slurry during cementing should the plug 10 be used inadvertently as a bottom wiper plug. Typically, the rupture element 23 is designed to rupture only at a predetermined pressure. The wipers 25 extend radially outward from the core 20 and covering 24 and are angled uphole slightly to permit flexing for insertion through the production casing 15. The wipers 25 act to wipe an inner surface 19 of the casing 15 and maintain separation between fluids above and below the cementing plug 10 during its insertion.

Two or more substantially inflexible projections, preferably radially extending holddown fingers 26, are formed in a space 27 defined by two of the plurality of wipers 25 extending from the cementing plug 10. A first end 28 of the holddown fingers 26 is embedded in the elastomeric covering 24 and a second end 29 extends at least equal to the extent of the flexed wipers 25 so that when the cementing plug 10 is positioned in the production casing 15, the second end 29 engages the inner wall 19 of the casing 15. The holddown fingers 26 are positioned to angle slightly uphole and are permitted limited flexing to aid in insertion of the cementing plug 10 into the casing 15 as a result of flexing of the elastomeric covering 24, however, once positioned at the bottom 11 of the casing 15, any uphole movement of the cementing plug 10 is prohibited as a result of limited rotation and compression of the holddown fingers 26 through engagement of the second end 29 of the holddown fingers 26 with the casing's inner wall 19. Typically, the holddown fingers 26 are manufactured from spring steel and may be tipped with carbide. The fingers 26 are substantially inflexible so as to be incapable of flexing or displacing overly so as to prevent the second ends 29 from losing their grip and disengaging from the casing's inner wall 19 in response to pressure from below the plug 10.

In a preferred embodiment of the invention, as shown in FIG. 2, two spring steel holddown fingers or carbide holddown fingers 26 are positioned 180 degrees circumferentially from one another about the plug 10. The holddown fingers 26 are blade-like, being approximately 1.5 inches in length and 1 inch in width and are angled to approximately the same degree as the wipers 25. Preferably, the first end 28 of each finger 26 is profiled or curved to form an anchor 30 so as to be more securely embedded in the elastomeric covering 24. Applicant has found that two holddown fingers 26 are sufficient to secure the cementing plug 10 in the casing 15, under test conditions. One holddown finger 26 may be sufficient as the wipers 25 already act to center the plug 10.

Figure 4:
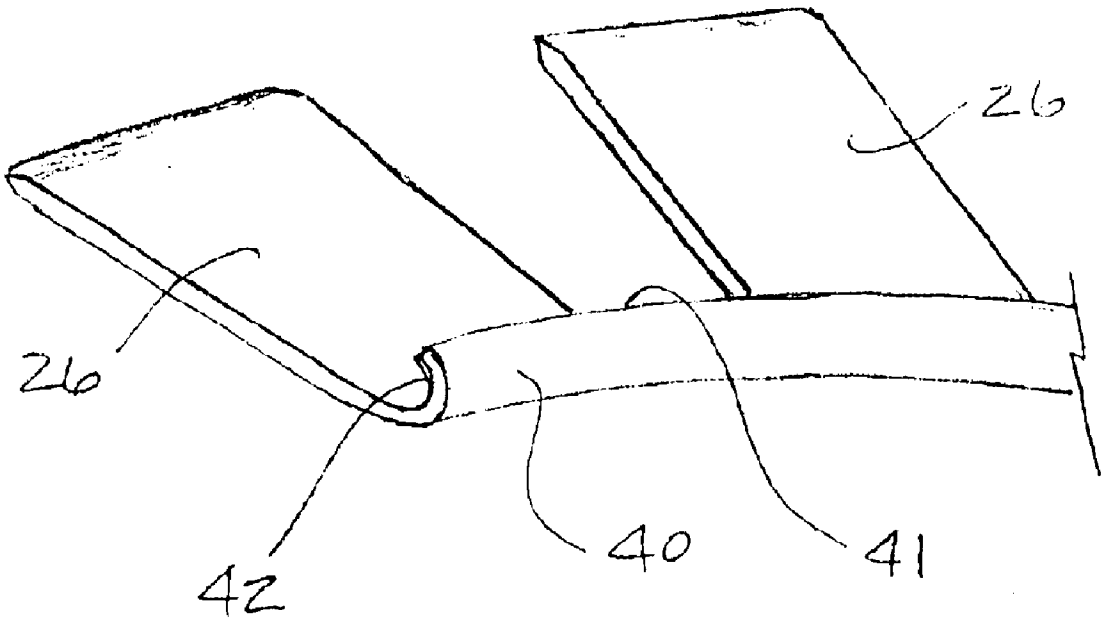
FIG. 4 is a partial perspective view of a ring to be secured around a core of the cementing plug and having a plurality of angled holddown fingers radially extending therefrom for engaging the casing.

A plurality of holddown fingers 26 may be spaced circumferentially about the plug individually, or joined as shown in FIG. 4. Each finger 26 may be separately embedded in the elastomeric covering 24 or, as shown in FIG. 4, for ease of production, the plurality of angled holddown fingers 26 may extending radially and cantilevered from a ring 40. The ring 40 can be embedded in the elastomeric covering 24 about the core 20. Further, an inner edge 41 of the ring 40 can be profiled as an anchor 42 for better securing the ring 40 in the elastomeric covering 24.

Figure 3:
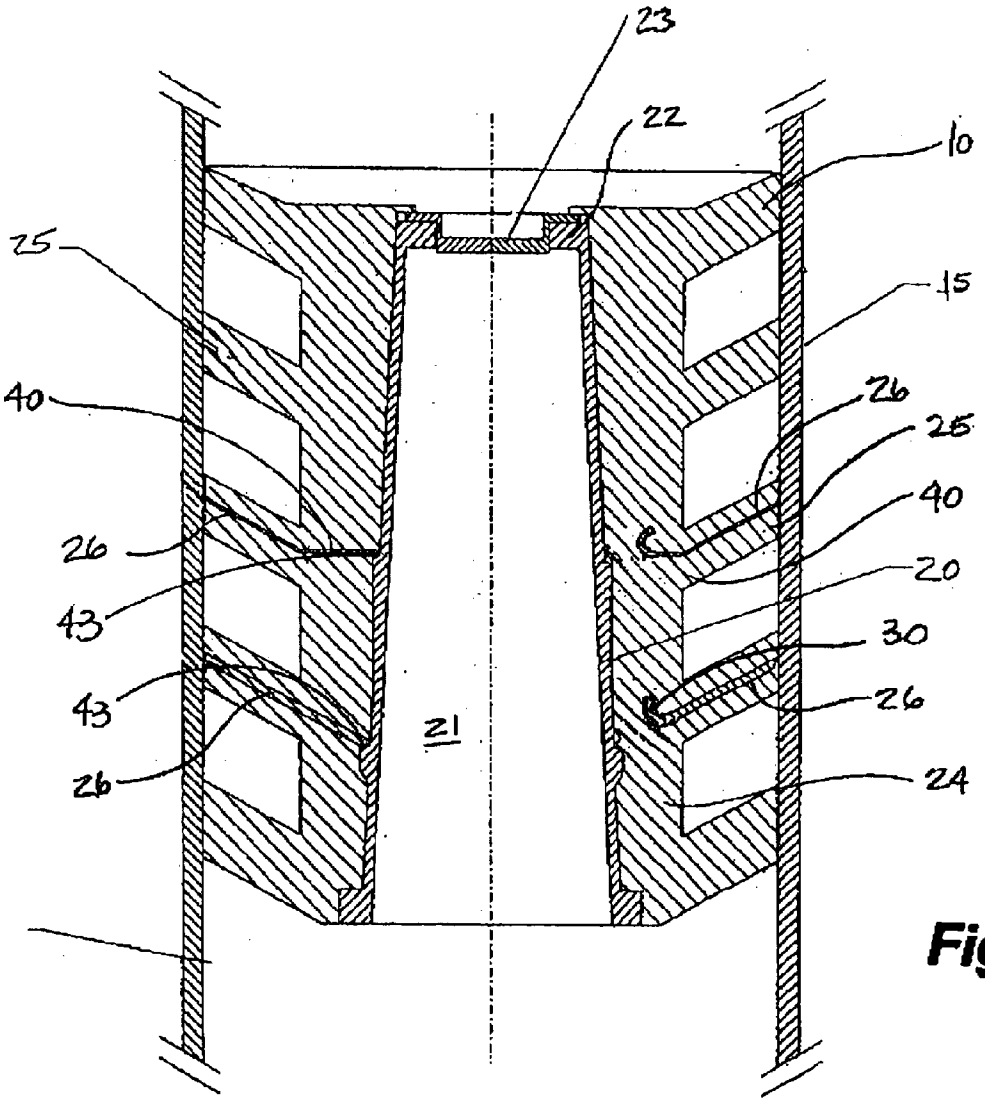
FIG. 3 is a cross-sectional view of a second embodiment of the invention showing spring steel holddown fingers and carbide-tipped holddown fingers embedded in the wipers of the cementing plug for engaging the production casing.

Having reference again to FIG. 3, and in a second embodiment of the invention, the holddown fingers 26 can be embedded within the elastomeric wipers 25. As is the case with the previously described embodiment, the holddown fingers 26 can be discrete and embedded individually within the wipers 25 or can extend periodically from a ring 40 which can be embedded about the core 20. Individually, the holddown fingers 26 may extend from the cementing plug's core 20 or may have an anchor 30 formed at the first end 28 permitting the finger 26 to extend from within the elastomeric covering 24.

For imparting further compressive strength, the holddown fingers 26 extending from the core 20 rest upon a shoulder 43 formed about the core 20 and provide additional resistance to inward flexing of the fingers 26.

Figure 5:
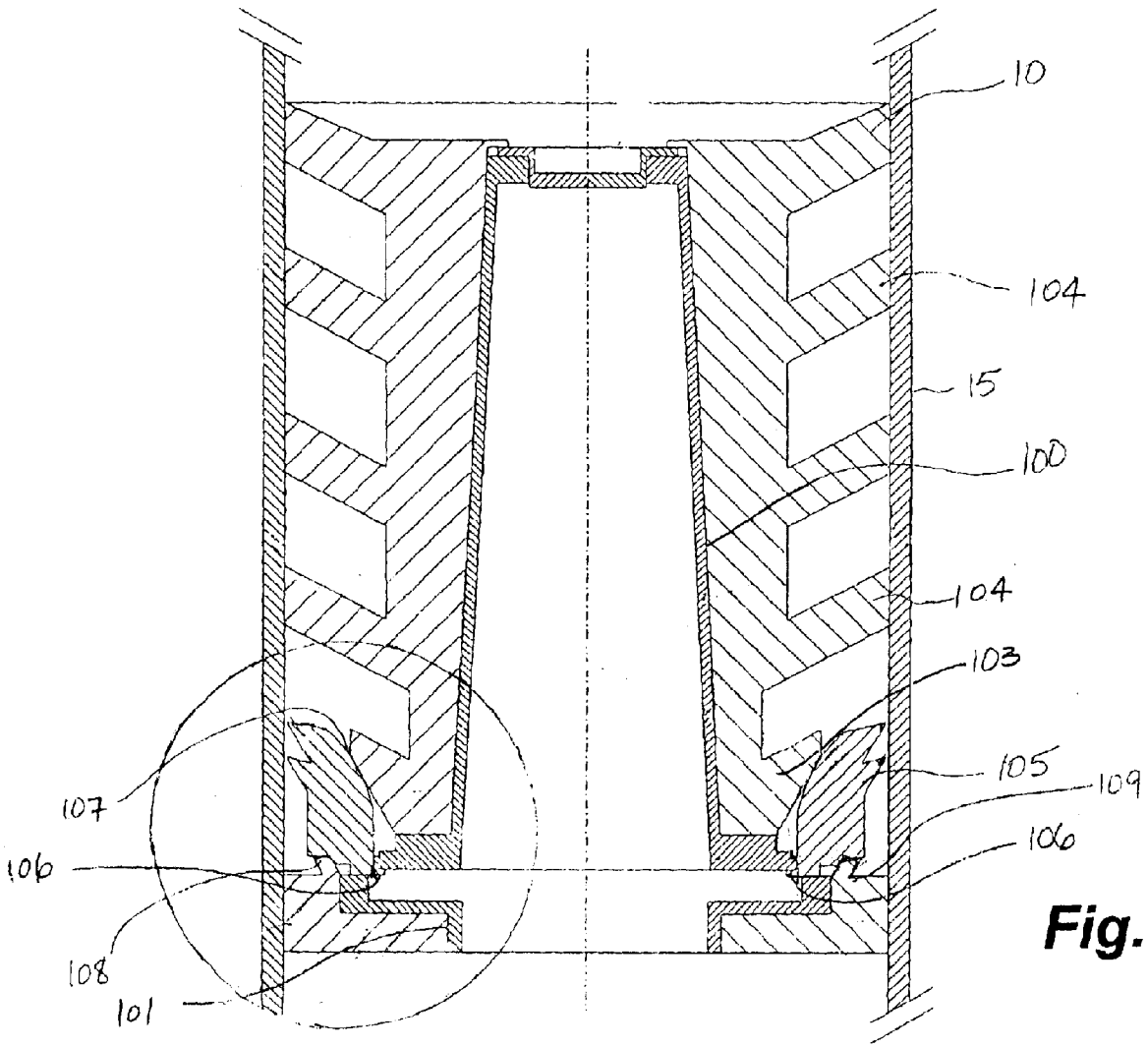
FIG. 5 is a cross-sectional view of a third embodiment of the invention showing a plurality of slips having carbide tips at a bottom end of the plug for engaging the production casing, the slips in a non-engaged position for insertion into the casing.

Having reference to FIG. 5, a third embodiment of the invention is shown. The plugs core 20 is formed in two portions, an upper core 100 and a lower core 101. A unitary elastomeric covering 103 is formed over both the upper and lower core 100, 101 from which a plurality of upwardly angled wipers 104 extend. A plurality of slips 105 are shearably connected between the upper and lower core 100, 101, preferably by shear tabs 106. The slips 105 reside in openings or ports 107 in the elastomeric covering 103, proximate to the bottom of the core's upper portion 100. In a casing non-engaging position, the slips 105 are retracted sufficient to permit insertion of the plug 10 into the casing 12. A stop 108 is formed in the elastomeric covering 24 adjacent a base 109 of the slip 105 and is deformed outwardly by the slip 105, biasing the slip 105 into the port 107.

Figure 6:
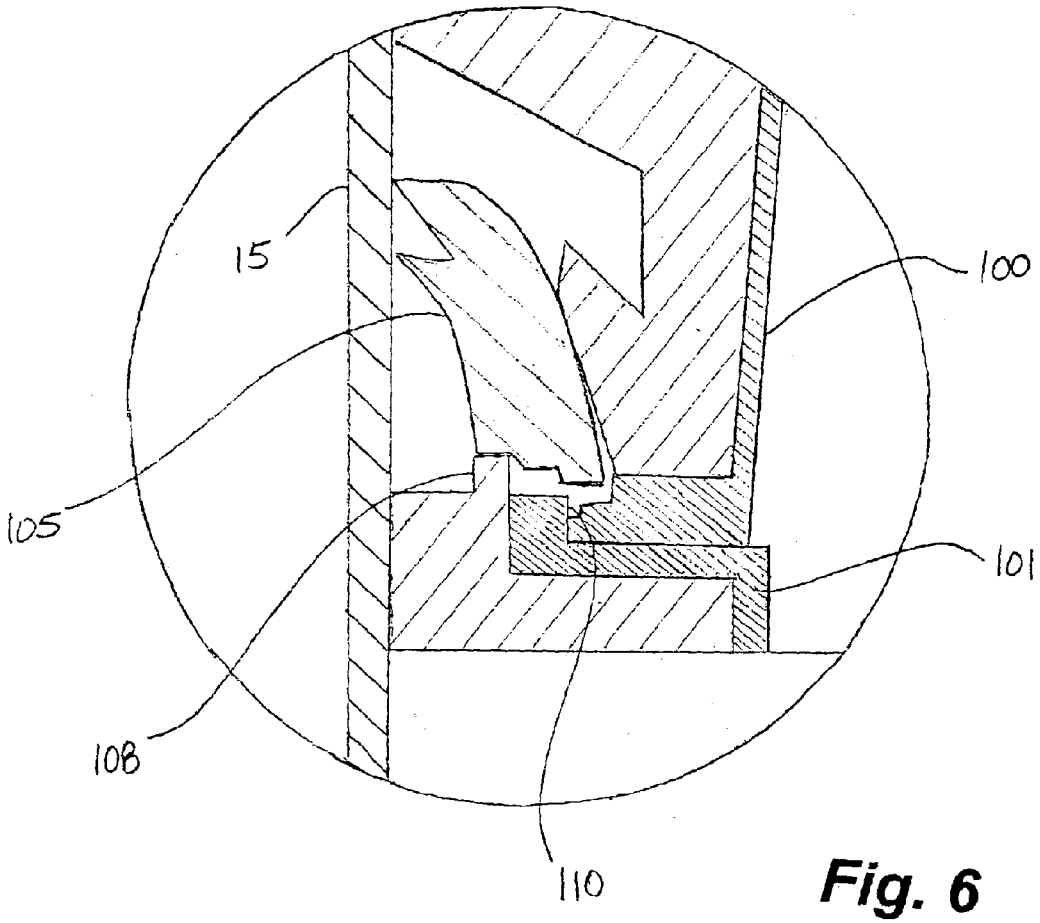
FIG. 6 is a cross-sectional view of the third embodiment according to FIG. 5 wherein a shear surface has been sheared and the slips are caused to be positioned in an engaged position.

In operation, as shown in FIG. 6, once the top plug 10 is set upon the bottom plug (not shown) and pressure is applied as a result of drilling fluid, the upper core 100 is forced downward into a recess 110 formed in the lower core 101 causing the shear tabs 106 to shear. The elastomeric covering 103 deforms inward forcing the slips 105 outward into engagement with the production casing 15. The movement of the slip 105 releases the stop 108 from compression and the stop 108 is permitted to return inwardly to an upstanding position and aid in maintaining the position of the slips 105, tipped in the casing-engaging position.

The embodiments of the invention in which an exclusive property or privilege is claimed are defined as follows:

1. A self-anchoring cementing wiper plug having a plurality of radially extending, elastomeric wipers extending therefrom for insertion into a casing and for wiping engagement with an inner wall therein, the improvement comprising:

one or more substantially inflexible projections biased radially outward from the cementing wiper plug and angled uphole, wherein, the one or more projections are moveable inwardly sufficiently so as to permit downhole movement into and along the production casing and are sufficiently inflexible for gripping engagement with the inner wall of the casing to prevent uphole movement of the plug therein.

2. The cementing plug as described in claim 1 further comprising two or more substantially inflexible, circumferentially spaced projections and wherein the two or more substantially inflexible projections are individual holddown fingers.

3. The cementing plug as described in claim 2 wherein the two or more holddown fingers are embedded at a first end in an elastomeric covering and extend outward therefrom to contact the casing at a second end.

4. The cementing plug as described in claim 3 wherein the two or more holddown fingers are positioned in a space formed between two adjacent wipers.

5. The cementing plug as described in claim 3 wherein the two or more holddown fingers are embedded in the elastomeric wipers.

6. The cementing plug as described in claim 3 wherein the holddown fingers are constructed of spring steel.

7. The cementing plug as described in claim 3 wherein the second ends of the holddown fingers are carbide tipped.

8. The cementing plug as described in claim 3 further comprising an anchor formed at the first end of the finger for anchoring the finger in the elastomeric covering.

9. The cementing plug as described in claim 3 further comprising a ring from which the holddown fingers extend.

10. The cementing plug as described in claim 9 further comprising an anchor formed about an inner edge of the ring for securing the ring in the elastomeric covering.

11. The cementing plug as described in claim 3 comprising two holddown fingers circumferentially spaced 180 degrees relative to each other, about the plug.

12. The cementing plug as described in claim 3 further comprising a plurality of holddown fingers spaced circumferentially about the plug.

13. The cementing wiper plug as described in claim 1 wherein the substantially inflexible projections are slips.

14. The cementing wiper plug as described in claim 13 wherein the slips are biased outwardly for engaging the casing.

15. The cementing wiper plug as described in claim 14 wherein the slips are biased outwardly by an elastomeric covering.

16. The cementing plug as described in claim 13 wherein the slips are shearable from a non engaging position to a casing engaging position.

17. A cementing wiper plug having a plurality of radially extending, elastomeric angled wipers for wiping an inside surface of casing, the improvement comprising:

one or more slips biased radially outward from the cementing plug for engaging the casing and preventing uphole movement of the plug, wherein, the slips are moveable from a first casing non-engaging position to a second casing engaging position.

18. The cementing plug as described in claim 17 further comprising:

an inflexible core having an upper portion and a lower portion, the lower portion having a recess for receiving the upper portion;

a unitary elastomeric covering enclosing the upper and lower portions from which the wipers extend and having a plurality of ports spaced circumferentially thereabout and proximate a lower end of the upper portion;

a plurality of slips, each slip being shearably connected between the upper and lower core and stowed in the ports in the elastomeric covering in the casing non-engaging position wherein, when the connection between the slips and the core is sheared, the top core is displaced downward into the recess in the bottom core and the slips are forced outwards into engagement with the casing.

19. The cementing wiper plug as described in claim 18 wherein the shearable connection is a plurality of shear tabs connected between the upper core and the lower core.

* * * * *